US005842511A

United States Patent [19]

Raybould et al.

[11] Patent Number: 5,842,511

[45] **Date of Patent: *Dec. 1, 1998**

[54] CASTING WHEEL HAVING EQUIAXED FINE GRAIN QUENCH SURFACE

[75] Inventors: Derek Raybould, Denville; Chin Fong Chang, Morris Plains, both of N.J.; David Teller, Petersburg, Va.; Howard Horst Liebermann, Succasunna; Nicholas J. DeCristofaro, Chatham, both of N.J.

[73] Assignee: AlliedSignal Inc., Morris Township, N.J.

[ * ] Notice: The term of this patent shall not extend beyond the expiration date of Pat. No. 5,564,490.

[21] Appl. No.: 699,274

[22] Filed: Aug. 19, 1996

[51] Int. Cl.[6] ..... B22D 11/06

[52] U.S. Cl. ..... 164/423; 164/429

[58] Field of Search ..... 164/423, 429, 164/463, 480, 479

[56] References Cited

U.S. PATENT DOCUMENTS

| | | | |
|---|---|---|---|
| 3,847,681 | 11/1974 | Waldman et al. | 148/11.5 A |
| 4,142,571 | 3/1979 | Narasimhan | 164/88 |
| 4,537,239 | 8/1985 | Budzyn et al. | 164/423 |
| 5,564,490 | 10/1996 | Liebermann et al. | 164/423 |

FOREIGN PATENT DOCUMENTS 0 024 506 9/1984 European Pat. Off. .

*Primary Examiner*—Patrick Ryan
*Assistant Examiner*—I.-H. Lin
*Attorney, Agent, or Firm*—Ernest D. Buff; John A. Squires

[57] ABSTRACT

A casting wheel quench surface rapidly solidifies molten alloy into strip having a microcrystalline or amorphous structure. The surface is composed of a thermally conducting alloy having a homogeneous microstructure consisting of fine equiaxed recrystallized grains. The grains exhibit a tight Gaussian grain size distribution.

8 Claims, 9 Drawing Sheets

CASTING WHEEL HAVING EQUIAXED FINE GRAIN QUENCH SURFACE

BACKGROUND OF THE INVENTION

1. Field of the Invention

This invention relates to manufacture of ribbon or wire by rapid quenching of a molten alloy; and more particularly, to characteristics of the surface used to obtain the rapid quench. A casting wheel quench surface having a fine, equiaxed, recrystallized microstructure, exhibiting a tight Gaussian grain size distribution has surprisingly been found to improve the quality of the surface finish of the rapidly solidified strip.

2. Description of the Prior Art

Continuous casting of alloy strip is accomplished by depositing molten alloy onto a rotating casting wheel. Strip forms as the molten alloy stream is attenuated and solidified by the wheel's moving quench surface. For continuous casting, this quench surface must withstand mechanical damage which may arise from cyclical stressing due to thermal cycling during casting. Means by which improved performance of the quench surface can be achieved include the use of alloys having high thermal conductivity and high mechanical strength. Examples include copper alloys of various kinds, steels and the like. Alteratively, various surfaces can be plated onto the casting wheel quench surface to improve its performance, as disclosed in European Patent No. EP0024506. A suitable casting procedure is set forth in detail in U.S. Pat. No. 4,142,571, the disclosure of which is incorporated herein by reference.

Casting wheel quench surfaces of the prior art generally involve one of two forms: monolithic or component. Monolithic quench surfaces comprise a solid block of alloy fashioned into the form of a casting wheel that is optionally provided with cooling channels. Component quench surfaces comprise a plurality of pieces that, when assembled, constitute a casting wheel, as disclosed in U.S. Pat. No. 4,537,239. The casting wheel quench surface improvements of the present disclosure are applicable to all kinds of casting wheels.

When selecting materials for construction of a casting wheel quench surface, certain mechanical properties such as hardness, tensile and yield strength, and elongation have generally been considered, sometimes in combination with thermal conductivity. This was done in an effort to achieve the best combination of thermal conductivity and mechanical strength properties possible for a given alloy. The reason for this is basically twofold: 1) to provide a high quench in the cast, 2) to resist mechanical damage of the quench surface which causes degradation of the strip's geometric definition. Dynamic or cyclical mechanical properties must also be considered in order to develop a quench surface which has superior performance characteristics.

One consequence of a poor selection of the material is rapid deterioration of the casting wheel surface due to the formation of pits. Pits are small defects that are usually observed when they larger than about 0.1 mm deep; they grow in depth and diameter as casting proceeds. These surface irregularities result in corresponding defects, "pips", in the cast ribbon. These pips not only affect the surface finish of the ribbon, but can also reduce the ribbon's usefulness in such applications as transformer cores, anti-theft systems and brazed articles. The importance of these surface defects to the value of the rapidly quenched ribbon and the customer's satisfaction is evident.

The surface defects limit the life of the casting wheel quench surface and reduces the surface quality of ribbon cast thereon. This, in turn, reduces the usefulness of such ribbon to the customer, whose designs must account for properties associated with the worst surface quality of the ribbon he might receive. Even when a good selection of mechanical and thermal properties is made, as is the case with the Cu Cr and Cu Be type alloys, the deterioration of a casting wheel's quench surface finish progresses rapidly. There exists a need in the art for a quench surface that resists rapid deterioration and produces, for a prolonged period of time, ribbon having a surface which is defect free.

SUMMARY OF THE INVENTION

The present invention provides an apparatus for continuous casting of alloy strip. Generally stated, the apparatus has a casting wheel comprising a rapidly moving quench surface that cools a molten alloy layer deposited thereon for rapid solidification into a continuous alloy strip. The quench surface is composed of a thermally conducting alloy having a fine, equiaxed, recrystallized microstructure, exhibiting a tight Gaussian grain size distribution.

The casting wheel of the present invention optionally has a cooling means for maintaining said quench surface at a substantially constant temperature throughout the time that molten alloy is deposited and quenched thereon. A nozzle is mounted in spaced relationship to the quench surface for expelling molten alloy therefrom. The molten alloy is directed by the nozzle to a region of the quench surface, whereon it is deposited. A reservoir in communication with the nozzle holds a supply of molten alloy and feeds it to the nozzle.

Preferably, the quench surface is comprised of fine equiaxed recrystallized grains exhibiting a tight Gaussian grain size distribution and an average grain size less than 80 $\mu$m. Use of a quench surface having these qualities significantly increases the service life of the quench surface. Run times for casts conducted on the quench surface are significantly lengthened, and the quantity of material cast during each run is increased by a factor as high as three or more. Ribbon cast on the quench surfaces exhibits far fewer surface defects, and hence, an increased pack factor (% lamination); and the efficiencies of electrical power distribution transformers made from such ribbon are improved. Run response of the quench surface during casting is remarkably consistent from one cast to another, with the result that the run times of substantially the same duration are repeatable and scheduling of maintenance is facilitated. Advantageously, yields of ribbon rapidly solidified on such surfaces are markedly improved, maintenance of the surfaces is minimized, and the reliability of the process is increased.

BRIEF DESCRIPTION OF THE DRAWINGS

The invention will be more fully understood and further advantages will become apparent when reference is made to the following detailed description and the accompanying drawings, in which.

DETAILED DESCRIPTION OF THE INVENTION

Figure 1:
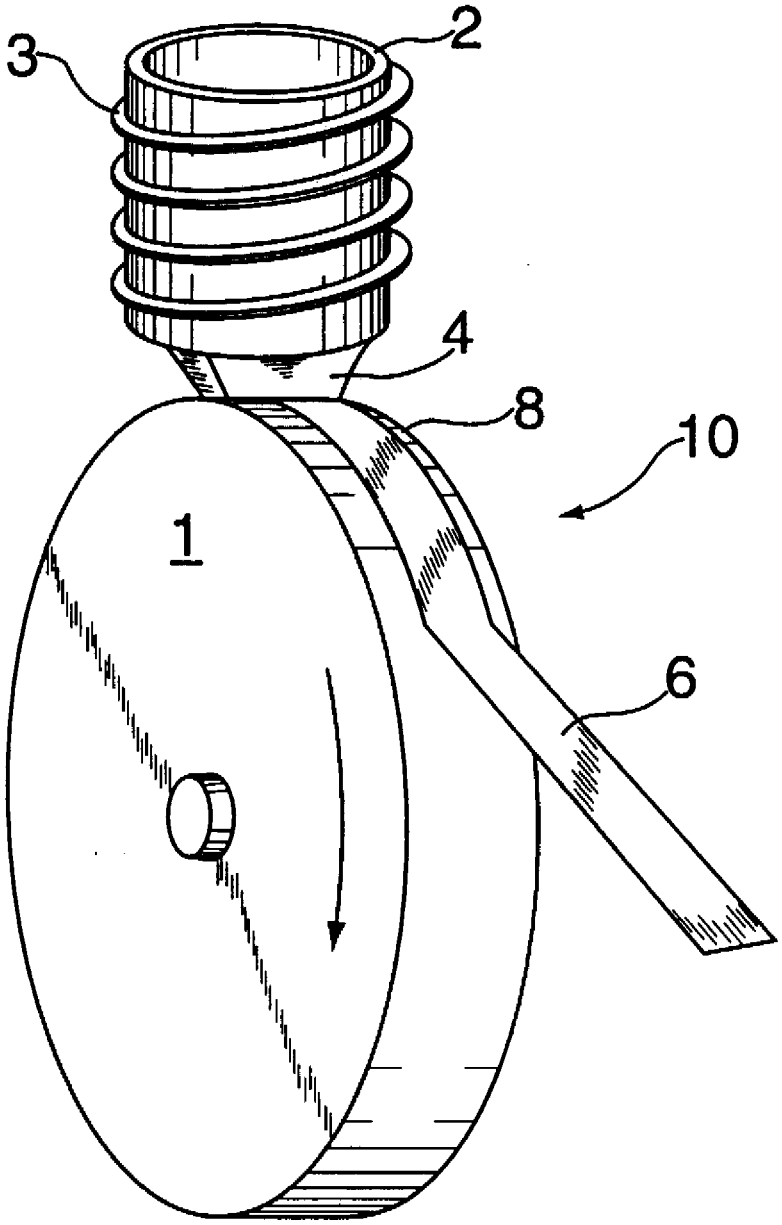
FIG. 1 is a perspective view of an apparatus for continuous casting of metallic strip.

As used herein, the term "amorphous metallic alloys" means a metallic alloy that substantially lacks any long range order and is characterized by X-ray diffraction intensity maxima which are qualitatively similar to those observed for liquids or inorganic oxide glasses.

The term microcrystalline alloy, as used herein, means an alloy that has a grain size less than 10 $\mu$m (0.0004 in.). Preferably such an alloy has a grain size ranging from about 100 nm (0.000004 in.) to 10 $\mu$m (0.0004 in.), and most preferably from about 1 $\mu$m (0.00004 in.) to 5 $\mu$m (0.0002 in.).

Grain size as used herein is taken to have been determined by an image analyzer looking directly at an alloy sample that has been polished and correctly etched to reveal grain boundaries. The average grain size was determined using five different locations within the sample chosen at random. In all cases the magnification was reduced to that at which the largest grains in the sample fit completely within the field of view. If there were any uncertainties, the grain size was determined at different magnifications to ensure it did not change with magnification.

As used herein, the term "strip" means a slender body, the transverse dimensions of which are much smaller than its length. Strip thus includes wire, ribbon, and sheet, all of regular or irregular cross-section.

The term "rapid solidification", as used herein throughout the specification and claims, refers to cooling of a melt at a rate of at least about $10^4$ to $10^{6°}$ C./s. A variety of rapid solidification techniques are available for fabricating strip within the scope of the present invention such as, for example, spray depositing onto a chilled surface, jet casting, planar flow casting, etc.

As used herein, the term "wheel" means a body having a substantially circular cross section having a width (in the axial direction) which is smaller than its diameter. In contrast, a roller is generally understood to have a greater width than diameter.

The term "thermally conducting", as used herein, means that the quench surface has a thermal conductivity value greater than 40 W/m K and less than about 400 W/m K, and more preferably greater than 60 W/m K and less than about 400 W/m K, and most preferably greater than 80 W/m K and less than 400 W/m K.

As used herein the term "normalized ribbon quantity cast" refers to the quantity/mass of ribbon that it was possible to cast on a particular wheel, normalized to a standard wheel.

The term "solution heat treatment", as used herein, means heating the alloy to a temperature at which all the alloy additions are in solution. This often results in recystallization occurring once the alloy additions are in solution. The actual solution heat treatment temperature depends upon the alloy. Copper beryllium alloy 25 is usually solution treated within the range 745° to 810° C. After solution heat treatment, the alloy is rapidly cooled to maintain the alloy additions in solution. In this state, the alloy is soft and ductile and easily worked.

As used herein the term "aging" means the low temperature exposure used to precipitate alloy additions from the solution heat treated alloy. The precipitation of strengthening phases hardens the alloy. Aging times and temperature are optimized to obtain the maximum hardness and, hence, strength. The copper beryllium alloy 25 is usually aged at 260° to 370° C. for ½ to 4 hours. Excessive aging time results in loss of hardness, strength and ductility. Because copper beryllium alloys are usually sold in the solution heat treated condition, aging of copper beryllium alloys is usually referred to simply as "heat treatment".

The term "Gaussian", as used herein, means a normal standard distribution around an average value. For certain cases close to zero in the examples the distribution is positively skewed, because the grains can not have negative values. Such cases in this work are still referred to for simplicity as a Gaussian distribution.

As used herein the term "tight" means that there is very little variance around the Gaussian or normal distribution. The term narrow Gaussian distribution could also be used as opposed to a wide Gaussian distribution.

In this specification and in the appended claims, the apparatus is described with reference to the section of a casting wheel which is located at the wheel's periphery and serves as a quench surface. It will be appreciated that the principles of the invention are applicable, as well, to quench surface configurations such as a belt, having shape and structure different from those of a wheel, or to casting wheel configurations in which the section that serves as a quench surface is located on the face of the wheel or another portion of the wheel other than the wheel's periphery.

The present invention provides a quench surface for use in rapid solidification, a process for using the quench surface in the rapid solidification of metallic strip, and a process for making the quench surface.

Referring to FIG. 1, there is shown generally at 10, an apparatus for rapid solidification of metallic strip. Apparatus 10 has an annular casting wheel 1 rotatably mounted on its longitudinal axis, reservoir 2 for holding molten metal and induction heating coils 3. Reservoir 2 is in communication with slotted nozzle 4, which is mounted in proximity to the surface 5 of annular casting wheel 1. Reservoir 2 is further equipped with means (not shown) for pressurizing the molten metal contained therein to effect expulsion thereof though nozzle 4. In operation, molten metal maintained under pressure in reservoir 2 is ejected through nozzle 4 onto the rapidly moving casting wheel surface 5, whereon it solidifies to form strip 6. After solidification, strip 6 separates from the casting wheel and is flung away therefrom to be collected by a winder or other suitable collection device (not shown).

The material of which the casting wheel quench surface 5 is comprised may be copper or any other metal or alloy having relatively high thermal conductivity. This requirement is particularly applicable if it is desired to make amorphous or metastable strip. Preferred materials of construction for surface 5 include precipitation hardened copper alloys, such as chromium copper or beryllium copper, dispersion hardened alloys, and oxygen-free copper. If desired, the surface 5 may be highly polished or chrome-plated or the like to obtain strip having smooth surface characteristics. To provide additional protection against erosion, corrosion or thermal fatigue, the surface of the casting wheel may be coated with a suitable resistant or high-melting material. Typically, a ceramic coating or a coating of corrosion-resistant, high-melting temperature metal is applicable, provided that the wettability of the molten metal or alloy being cast on the chill surface is adequate.

The deposition of molten alloy onto the quench surface as the wheel rotates during casting results in a large radial thermal gradient near the surface and large thermal cyclic stresses. These effects may combine to mechanically degrade the quench surface during casting.

We have discovered that the problems of mechanical degradation described above can be minimized by the use of a quench surface comprised of fine, equiaxed, recrystallized grains having a tight Gaussian grain size distribution with substantially no grain larger than 500 $\mu$m. Copper based alloys typically have a bimodal grain size distribution. In fact, copper alloys are the only alloys for which the American Society of Testing & Measurement grain size standard, ASTM E112, permits the average grain size to be specified by two sizes. Of the two sizes specified, one size is for the fine grains and one size is for the large grains. Typical values for these sizes would be 100 $\mu$m and 600 $\mu$m, respectively. For copper alloys, a range in grain sizes of about 5 to 1000 $\mu$m is normal.

Figure 2:
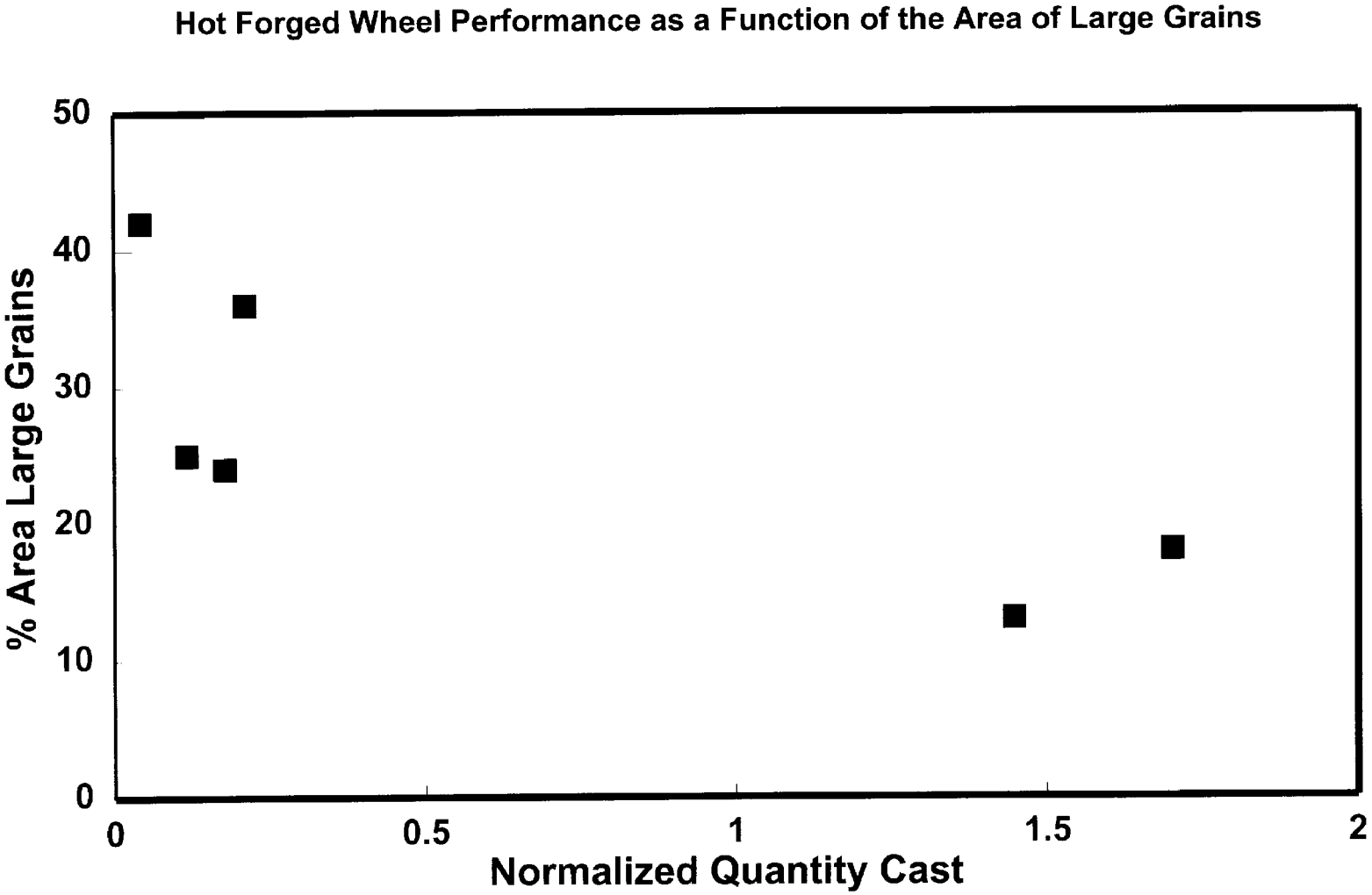
FIG. 2 illustrates the effect of the bimodal grain size distribution (quantified by the % area of large grains) on the life of hot forged casting wheels having conventional quench surfaces.
Figure 3:
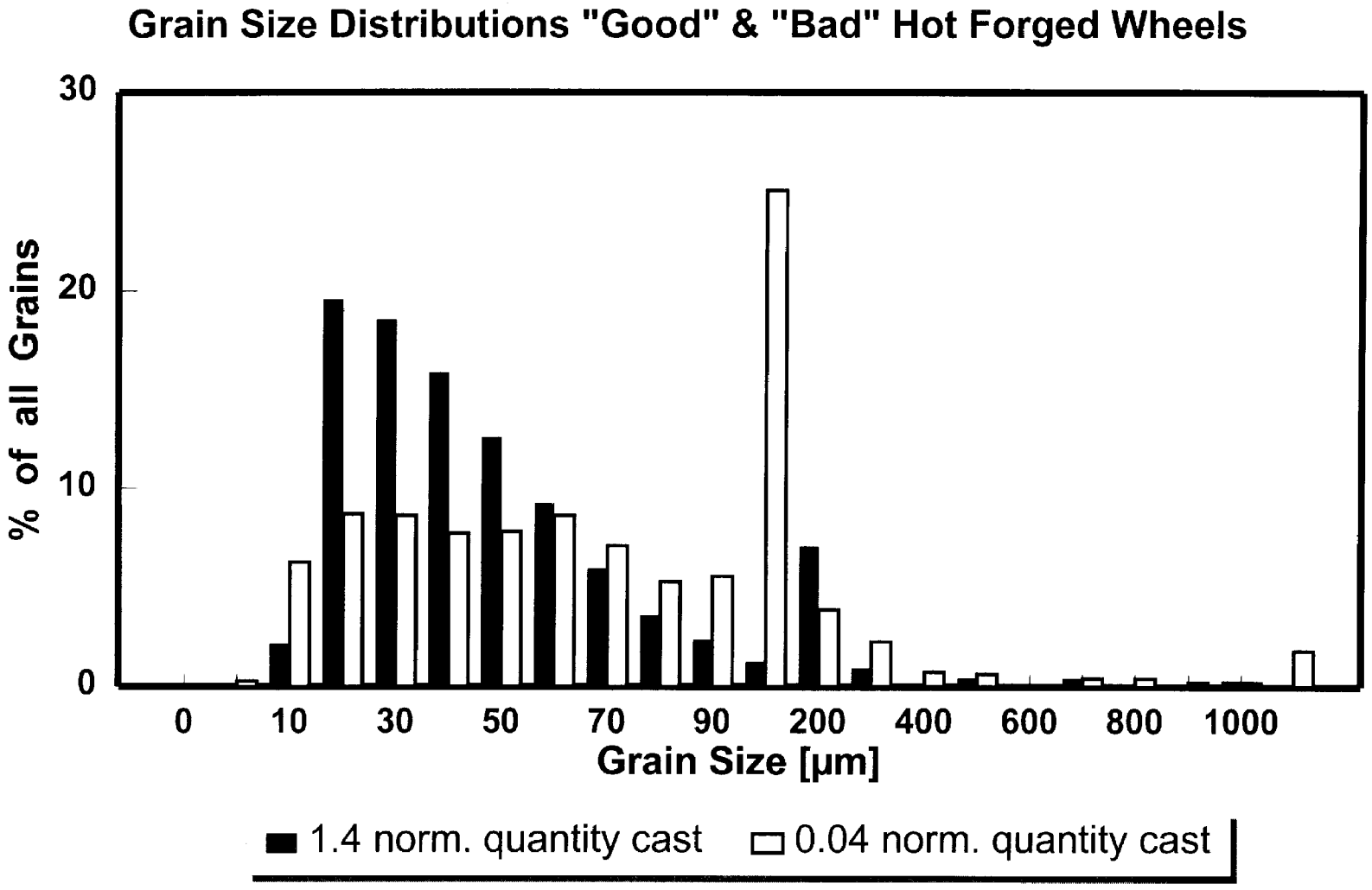
FIG. 3 is the grain size distribution of "good" and "bad" hot forged wheels, showing the bimodal grain size distribution.

The large grain size, commonly occurring in copper alloys because of the bimodal grain size distribution, is detrimental to the durability of the casting wheel. A series of copper casting wheels fabricated by hot forging were investigated in detail. All had a typical bimodal distribution typified by the ASTM grain size of 20 and 500 $\mu$m. It was found possible to quantify the degree of bimodal distribution and to take some account of the large grain size by using an image analyzer to determine the percentage of the casting wheel material with a grain size above 250 $\mu$m. As shown in FIG. 2, the hot forged wheels with a high percentage of large grains had a small normalized ribbon quantity cast, while the ones with a small percentage had a much larger normalized ribbon quantity cast. FIG. 3 depicts the grain size distribution of "good" and "bad" wheels. While each of the "good" and "bad" wheels have bimodal distributions, the wheel with the higher normalized quantity cast (1:4 compared to 0.04) has fewer large grains. Clearly large grains and a bimodal grain size distribution are deleterious to quench surface performance in the continuous casting of metal or alloy strip. Under these circumstances, the specific manner in which quench surface degradation occurs is through the formation of very small cracks in the surface thereof. Subsequently deposited molten metal or alloy then enters these small cracks, solidifies therein, and is pulled out, together with adjacent quench surface material, as the cast strip is separated from the quench surface during operation. The degradation process is degenerative, growing progressively worse with time. Cracked or pulled out spots on the quench surface are called "pits", while the associated replicated protrusions attached to the underside of the cast strip are called "pips."

It should be beneficial to reduce the bimodal distribution, by reducing the area of large grains further. However, it is difficult to obtain essentially a 100% fine grain size with conventional hot forging processes. Conventional hot forging usually involves working the metal by discrete hammer blows into an annular quench surface, to prepare it for subsequent heat treatment in order to develop high strength. The limitation of this mechanical working method is largely its discrete, incremental nature. That is, not all volume elements of the quench surface are equally worked and subsequent bimodal grain size distributions can occur, with the occurrence of large grains in a matrix of fine grains.

Alternate fabrication routes were therefore explored. These included forward and back extrusion, flow forming and hot and cold forging. Several provided an homogenous fine grained microstructure. While some of these improved wheel life, it was surprisingly found that even with an extremely fine (<30 $\mu$m) grain size a very low normalized ribbon quantity cast could be obtained. Even with a fine uniform grain size, performance was found to depend on the microstructure within the grain. Good, medium or very poor wheel life was obtained even though the average grain size of each of the wheels was less than 30 $\mu$m and no grain exceeded 250 $\mu$m.

Surprisingly, the best results were obtained with techniques that formed fine, equiaxed, recrystallized grains with a tight Gaussian grain size distribution. The benefits of such a microstructure are not limited to longer wheel life, but also include better equipment utilization and the production of ribbon having a superior surface finish. In the case of ribbon made from magnetic alloys, a better surface finish provides a higher packing factor, and a more efficient transformer. The benefits associated with improved ribbon quality have been found to significantly increase once the ribbon is made effectively "pip" free.

The following examples are presented to provide a more complete understanding of the invention. The specific techniques, conditions, materials, proportions and reported data set forth to illustrate the principles and practice of the invention are exemplary and should not be construed as limiting the scope of the invention.

EXAMPLE 1

Figure 4:
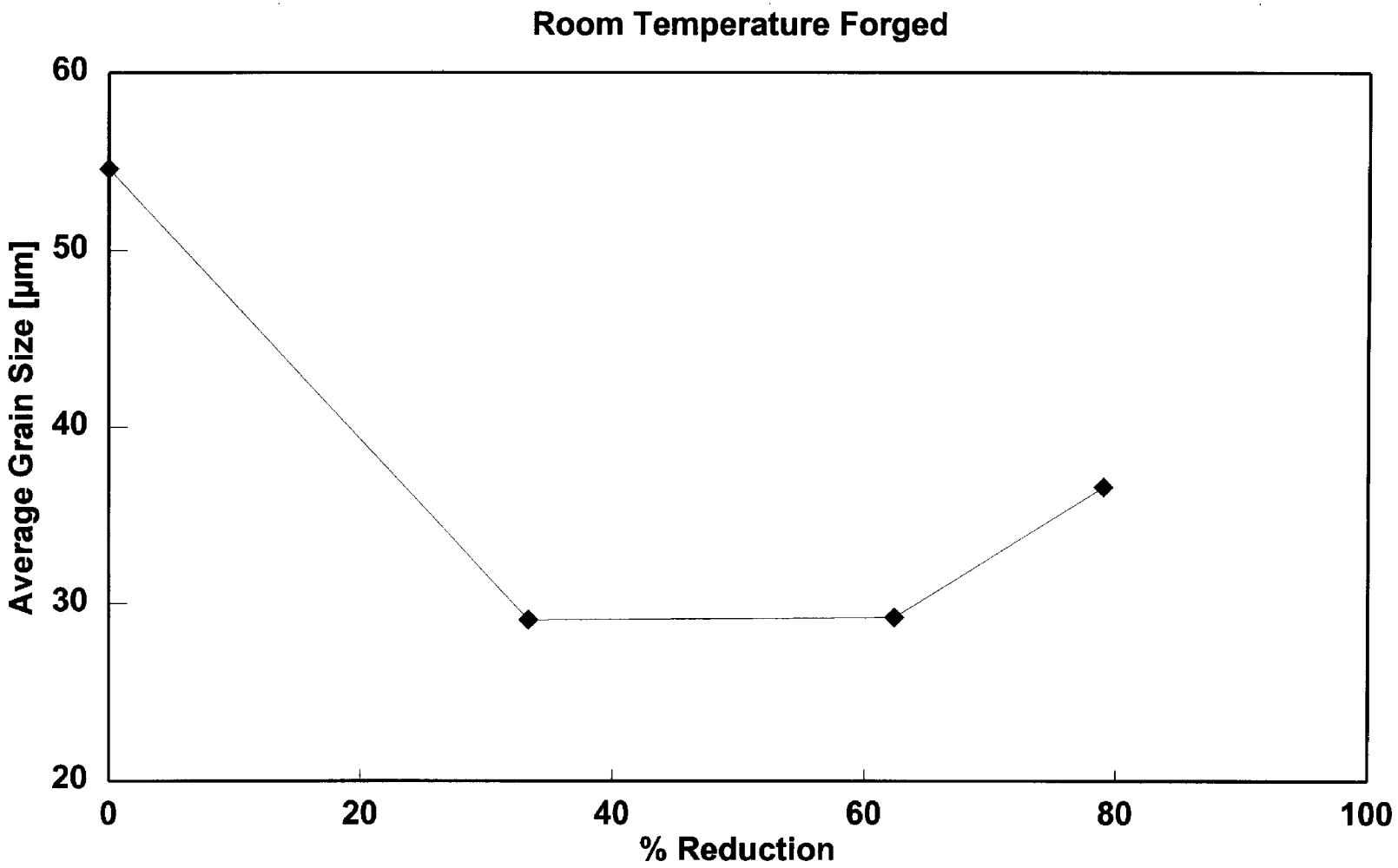
FIG. 4 illustrates how the degree of cold work effects the average grain size.

An ingot of the copper beryllium alloy 25 was hot side forged at 700° C. and pierced, after which it was hot forged and then cold forged to the final, desired casting wheel size. Specifically, the billet was hot forged to an intermediate size and then subjected to a 30% cold reduction to the final wheel size. FIG. 4 shows the average grain size obtained for samples given a standard hot forge and then cold forged to varying reductions prior to a standard solution heat treatment. The grain size obtained remains constant for a large range of cold work and can be expected to only change slightly outside the immediate range investigated in FIG. 4.

Figure 5:
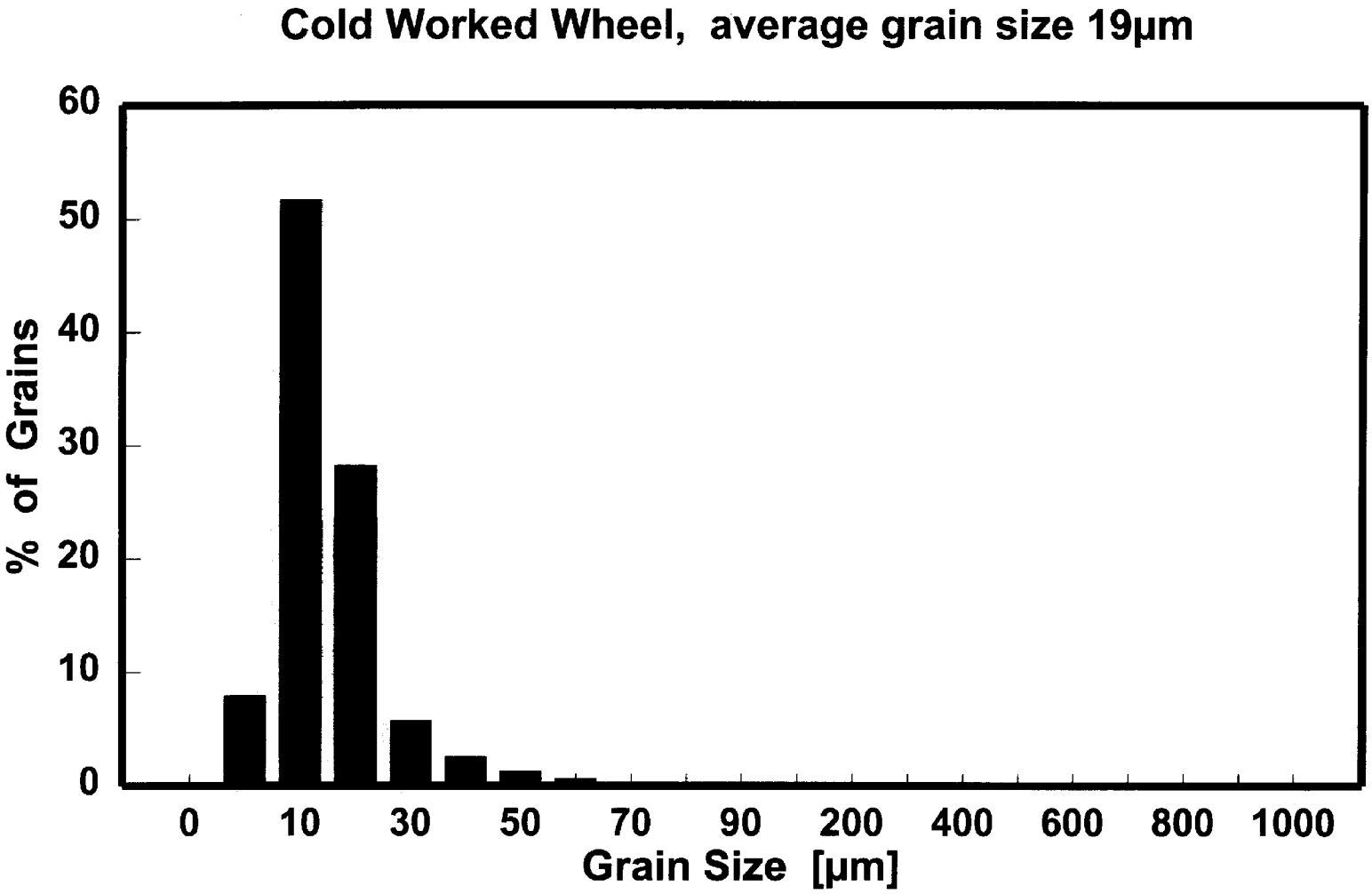
FIG. 5 is the grain size distribution obtained by cold working the wheel as described herein.
Figure 6:
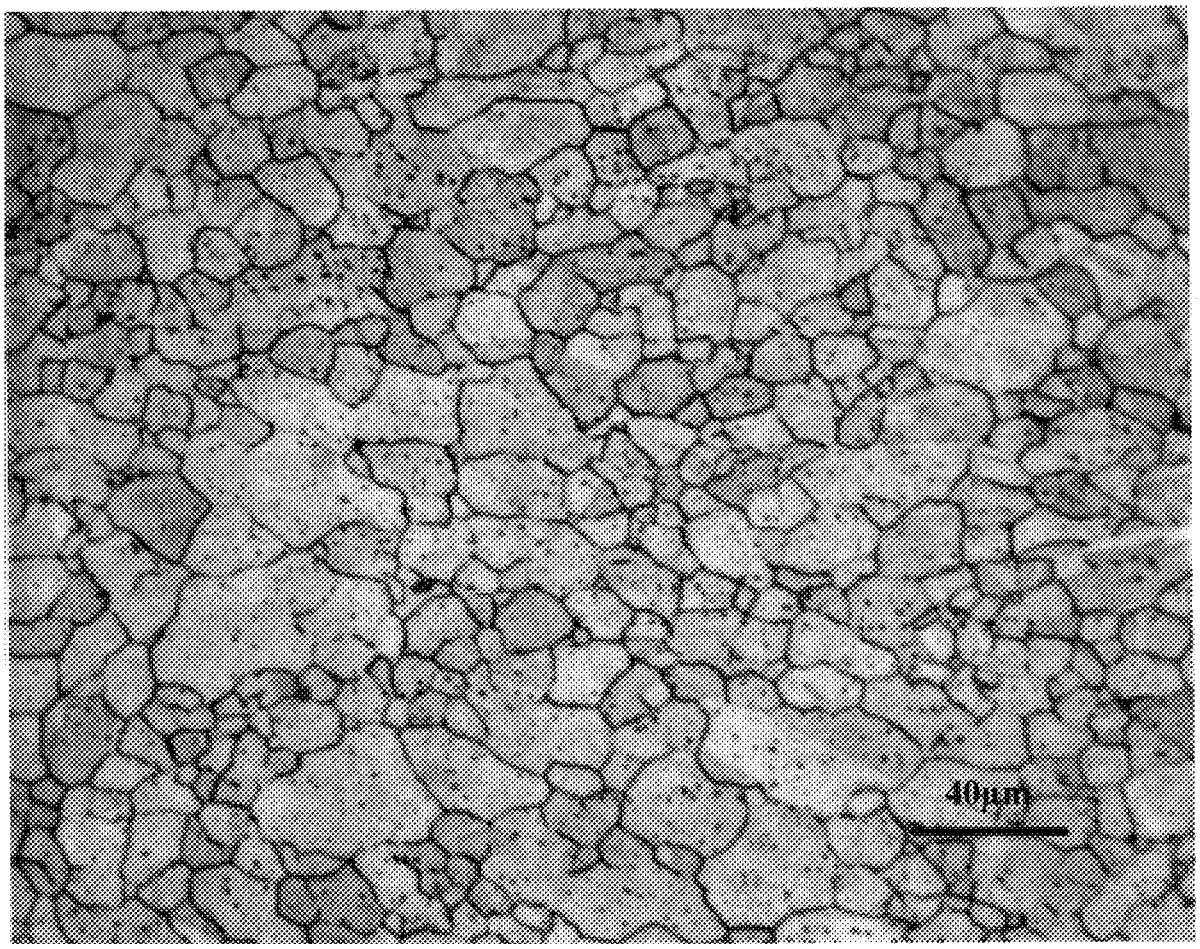
FIG. 6 is a micrograph of a cold forged wheel showing the recrystallized microstructure, the average grain size is less than 30 $\mu$m. The normalized ribbon quantity cast for this wheel was 2.9.

The 30% cold worked casting wheel was then given a standard solution heat treatment and aging prior to machining to the exact wheel dimensions and tolerances. The resultant Gaussian grain size distribution is shown in FIG. 5. These fine, equiaxed, recrystallized grains, shown in FIG. 6, resulted in this wheel having an extremely long life. The wheel described by FIGS. 5 & 6 had a normalized ribbon quantity cast of 2.9, which is approximately twice the value of the "best" hot forged wheel described in FIG. 2.

In most cases, the ribbon produced using this wheel had no pips. As a result, its lamination factor was increased. The desirability of this ribbon is, therefore, evident.

Additional casting wheels were fabricated by the process described above. In all cases, the wheel microstructure was comprised of fine, recrystallized, equiaxed grains exhibiting a tight Gaussian grain size distribution. These casting wheels all demonstrated superior casting performance as measured by the normalized ribbon quantity cast. This information is given in Table 1.

TABLE 1

| Rim Identificatio | Av. Grain Size* [microns] | Microstructure | Normalized ribbon quantity cast |
|---|---|---|---|
| 4-2 | 32 | recrystallized, equiaxed, Gaussian | 3.0 |
| 4-3 | 38 | recrystallized, equiaxed, Gaussian | 2.9 |
| 4-5 | 35 | recrystallized, equiaxed, Gaussian | 2.0 |
| 4-6 | 32 | recrystallized, equiaxed, Gaussian | 3.3 |
| 4-8 | 35 | recrystallized, equiaxed, Gaussian | 3.1 |

EXAMPLE 2

Figure 7:
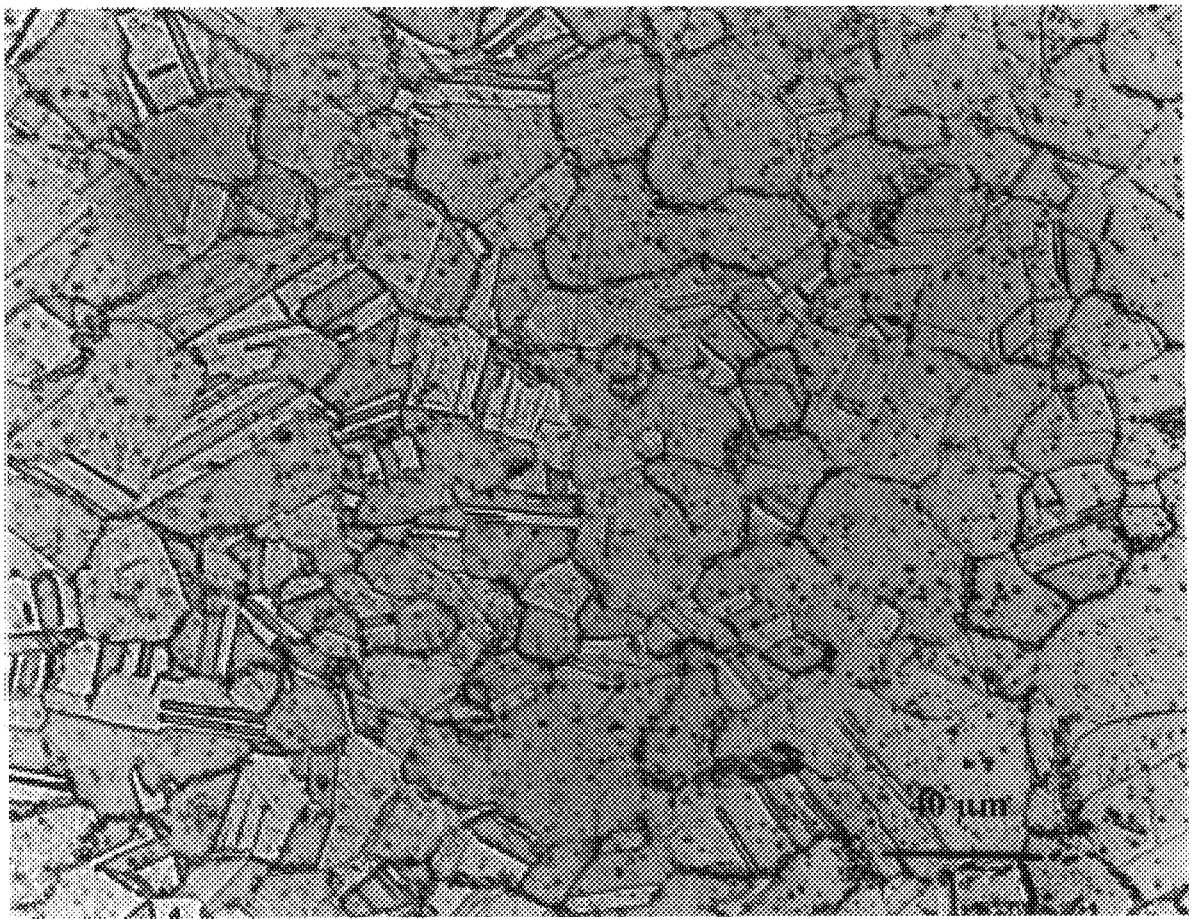
FIG. 7 is a micrograph of a hot forged wheel, the average grain size is less than 30 $\mu$m. The normalized ribbon quantity cast for this wheel was 1.7.

An ingot of the copper beryllium 25 alloy was hot side forged at 700° C. and pierced, as in example 1. In this example, the billet was then hot forged all the way to the final casting wheel size. An homogeneous microstructure was produced with a very fine average grain size, less than 30 $\mu$m. However, because of the absence of cold work, the grains were not all equiaxed, annealing twins were found within the grains and the grain size distribution was not Gaussian in shape. The microstructure of this wheel is shown in FIG. 7. Even though the microstructure was homogeneous and the average grain size was very fine (less than 30 $\mu$m), the normalized ribbon quantity cast of the casting wheel was only 1.7. This value for the normalized ribbon quantity cast was much less than the 2.9 value obtained in Example 1 when the wheel was processed in substantially the same way, except for the final cold work.

EXAMPLE 3

Figure 8:
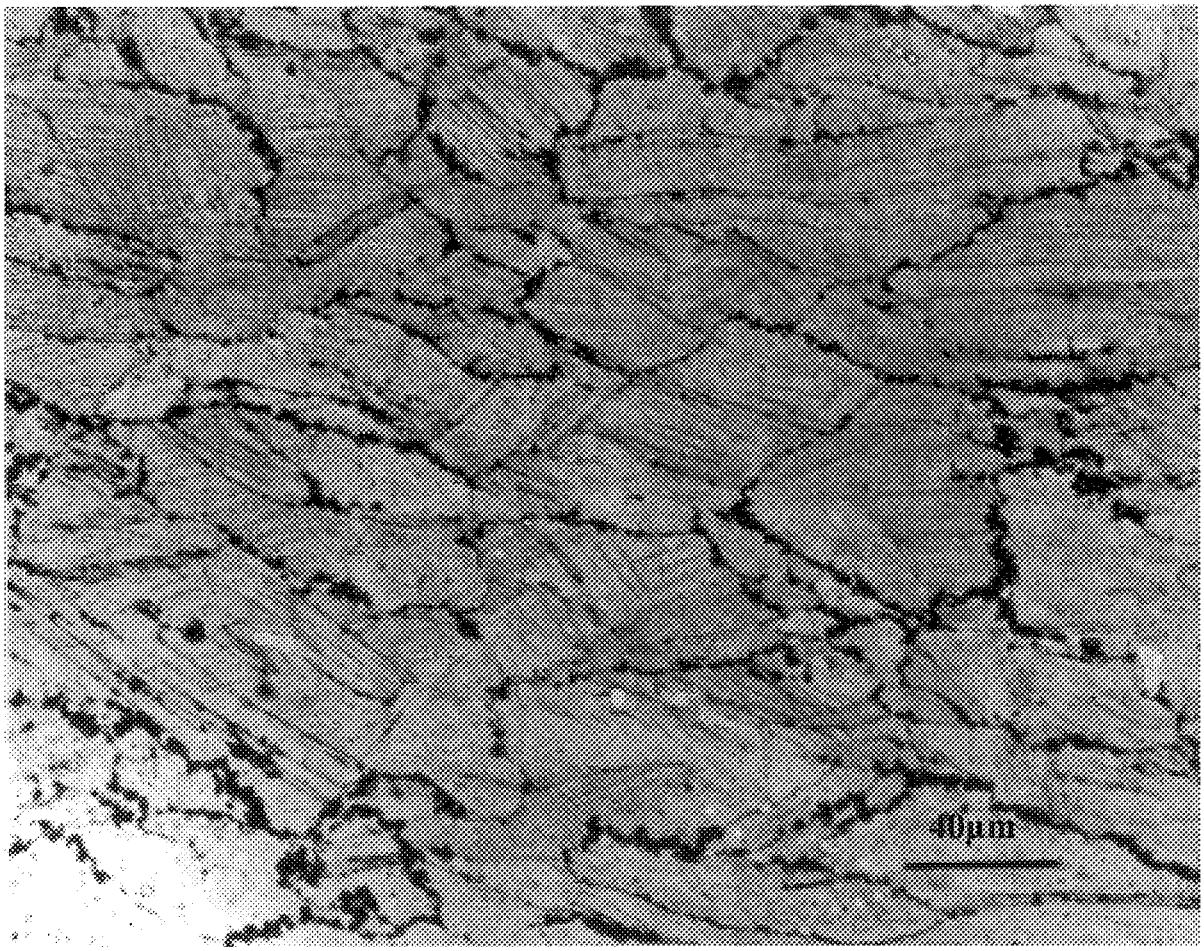
FIG. 8 is a micrograph of a cold forged and aged wheel, the average grain size is less than 30 $\mu$m. The normalized ribbon quantity cast for this wheel was 0.3.

An ingot of the copper beryllium alloy 25 was hot side forged at 700° C. and pierced. The billet was hot forged to an intermediate size and then given a 30% cold reduction to the final wheel size as in Example 1. After the cold work, the material was aged. Unlike the solutionized and aged material of Example 1, a recrystallized microstructure was not produced in this case. Instead, the wheel had a fine homogenous microstructure with highly deformed grains, which had an average grain size of 15 $\mu$m and a Gaussian grain size distribution with no grain larger than 200 $\mu$m. This homogenous fine microstructure shown in FIG. 8 might be expected to have a very high normalized ribbon quantity cast. But the casting wheel exhibited an extremely poor normalized ribbon quantity cast value of 0.3, which is much less than that of the average standard wheel, which has a significantly larger grain size.

The wheels described in Example 1, 2 and 3 all exhibit an average grain size less than 30 $\mu$m, but have very different microstructures. Only the wheel of Example 1 produced in accordance with the present invention and having a microstructure characterized by fine, equiaxed, recrystallized grains with a tight Gaussian grain size distribution has superior casting performance.

EXAMPLE 4

Casting wheels were formed by the direct hot extrusion of a tube. An ingot of the copper beryllium alloy 25 was upset hot forged to fit within the extrusion container. It was then pierced, while still hot, to the internal diameter of the tube to be extruded. After piercing, the billet was cooled, inspected and then reheated to the extrusion temperature of 650° C. The size of the extrusion container was chosen to give a reduction ratio of around 10:1, to ensure that a uniformly high deformation was given to the ingot. The extruded tube was given a standard solution heat treatment and aging. It was then sliced; each slice was machined to the exact dimensions and tolerances of the casting wheel.

Figure 9:
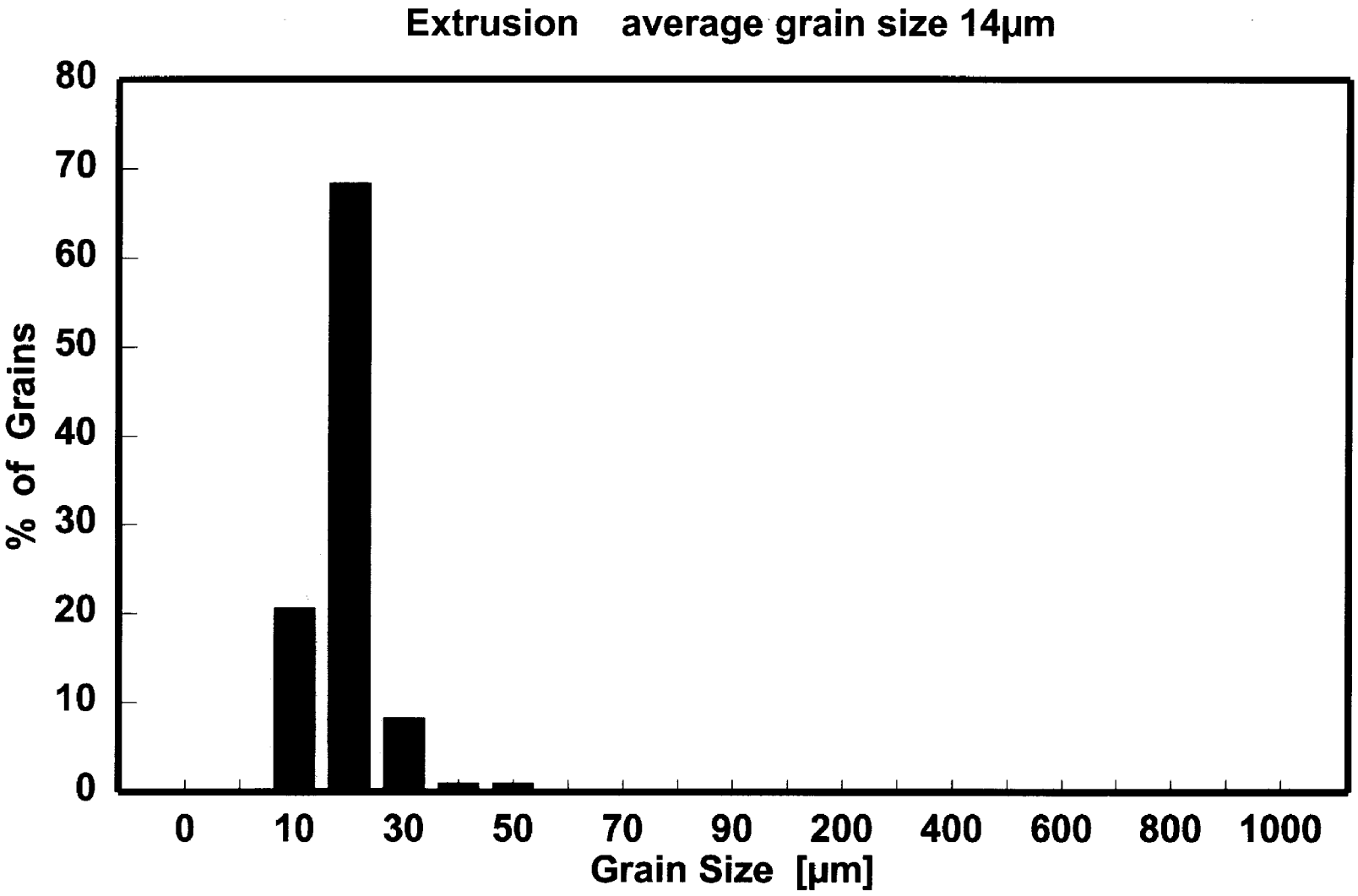
FIG. 9 is a grain size distribution obtained by extrusion, showing a tight Gaussian grain size distribution.

The resultant microstructure was found to be equiaxed and was characterized by a tight Gaussian grain size distribution, as shown in FIG. 9. The grains were recrystallized and, as such, were effectively free of dislocations associated with both cold and hot working of these alloys.

EXAMPLE 5

An ingot of the copper beryllium alloy 25 was hot upset forged, pierced and then hot forward extruded to a tube using the procedure described in Example 4. This tube was then cold flow formed to the required dimensions for a casting wheel, achieving a 50% reduction. As FIG. 4 shows a cold reduction of 20 to 70% could be used to achieve the optimum grain size. The flow formed tube was given a standard solution heat treatment, aged and machined to the required tolerances. The microstructure consisted of equiaxed grains with a tight Gaussian grain size distribution and an average grain size of approximately 30 $\mu$m.

Other mechanical working processes can be used instead of flow forming. One is cold saddle forging, which has been found to result in recrystallized grains with an extremely tight Gaussian grain size distribution with an average grain size of 20 $\mu$m. This wheel had a high normalized ribbon quantity cast value of 2.0. Another mechanical working process is ring rolling, in which an annular quench surface is subjected to continuous mechanical deformation throughout each element of volume. These continuous deformation processes produce a very fine, uniform grain size in accordance with the present invention.

In addition to the mechanical deformation processes described above, various heat treatment steps, carried out either between or during the mechanical deformation processes, may be utilized to facilitate processing and/or to recrystallize the quench surface grains, and to produce the hardening phases in the quench surface alloy.

Having thus described the invention in rather full detail, it will be understood that such detail need not be strictly adhered to but that various changes and modifications may suggest themselves to one skilled in the art, all falling within the scope of the present invention as defined by the subjoined claims.

What is claimed is:

1. A quench surface for rapid solidification of molten alloy into strip having an amorphous structure, said quench surface being composed of a copper based, thermally conducting alloy having a microstructure consisting of fine, equiaxed, recrystallized grains, the average size of said grains being less than 200 $\mu$m and none of said grains being larger than 500 $\mu$m, said grains having a tight Gaussian grain size distribution.

2. A quench surface as recited in claim 1, wherein said thermally conducting alloy is a precipitation-hardened copper alloy.

3. A quench surface as recited in claim 1, wherein said thermally conducting alloy is a dispersion-hardened copper alloy.

4. A quench surface as recited in claim 1, wherein said thermally conducting alloy is a beryllium copper alloy.

5. A quench surface as recited in claim 1, said alloy having a substantially homogenous microstructure wherein said grains have an average grain size less than 100 $\mu$m.

6. A quench surface as recited in claim 1, said alloy having a substantially homogenous microstructure wherein said grains have an average grain size less than 80 $\mu$m.

7. A quench surface as recited in claim 1, said alloy having a substantially homogenous microstructure wherein said grains have an average grain size less than 50 $\mu$m.

8. A quench surface as recited in claim 1, said alloy having a substantially homogenous microstructure wherein said grains have an average grain size less than 30 $\mu$m.

* * * * *